United States Patent [19]

Henning

[11] Patent Number: 4,531,323

[45] Date of Patent: Jul. 30, 1985

[54] TOY GLIDER SYSTEM

[76] Inventor: Peter J. Henning, 183 W. Cornell, Pontiac, Mich. 48055

[21] Appl. No.: 497,155

[22] Filed: May 23, 1983

[51] Int. Cl.[3] ..... A63H 27/00

[52] U.S. Cl. ..... 446/66; 244/34 A; 446/68

[58] Field of Search ..... 46/79, 78, 81, 76 R, 46/76 A, 74 R, 74 D; 273/424, 425; 244/153 R, 154, 34 A

[56] References Cited

U.S. PATENT DOCUMENTS

| | | | |
|---|---|---|---|
| 303,885 | 8/1884 | Ridge | 46/74 R |
| 2,313,948 | 3/1943 | Lambert | 46/81 |
| 2,953,378 | 9/1960 | Veigne, Jr. | 273/425 X |
| 3,031,797 | 5/1962 | Gelfand | 46/81 |
| 3,715,833 | 2/1973 | Nickerson et al. | 46/74 D X |
| 3,946,519 | 3/1976 | Vadik et al. | 46/79 |
| 4,174,834 | 11/1979 | De Martino | 273/425 |
| 4,301,614 | 11/1981 | Newton | 46/79 |
| 4,307,856 | 12/1981 | Walker | 244/34 A |
| 4,436,264 | 3/1984 | Brumfield | 244/34 A |

*Primary Examiner*—F. Barry Shay

*Attorney, Agent, or Firm*—Gifford, VanOphem, Sheridan, Sprinkle & Nabozny

[57] ABSTRACT

A hand propelled air glider type aerodynamic toy. The toy includes an elongated fuselage, a nosepiece which acts as a balance weight, a flat plastic or styrofoam member with an offset cutout which acts as the wings of the device, and a wing adjuster which secures the wing to the fuselage. The wing adjuster slidably accepts the fuselage to provide adjustments of the wing for different flight characteristics. The plastic fuselage passes through the cutout of the wing member thereby causing a slight upturn of the rear portion of the wing. The combination of the wing cutout and the angle of the wing construction with respect to the fuselage gives the device its aerodynamic properties.

7 Claims, 20 Drawing Figures

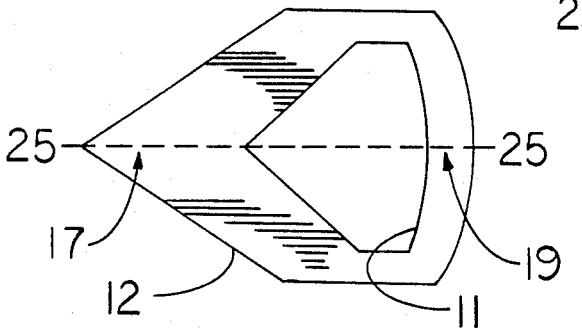
FIG.-6
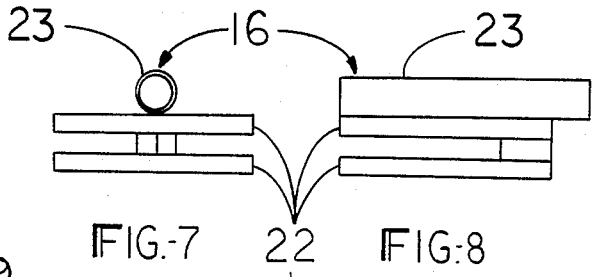
FIG.-7 FIG.-8
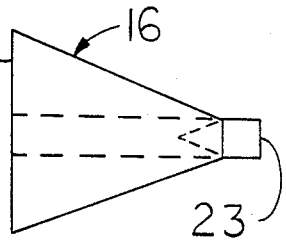
FIG.-9
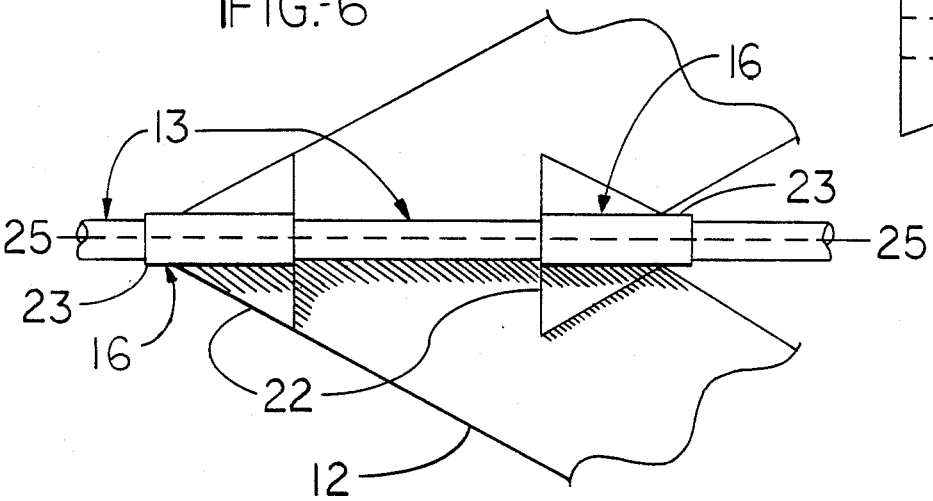
FIG.-10
FIG.-11a
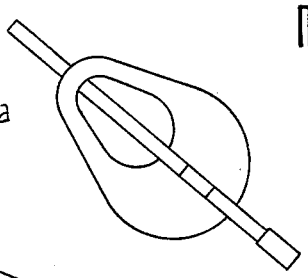
FIG.-11f
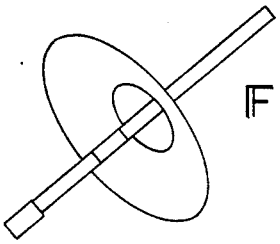
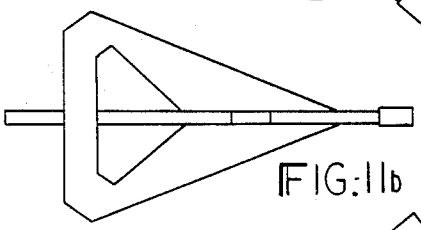
FIG.-11b
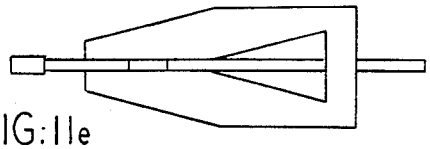
FIG.-11e
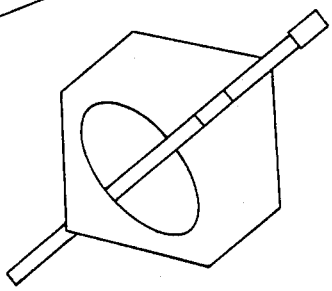
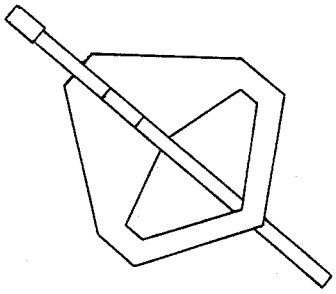
FIG.-11c FIG.-11d

TOY GLIDER SYSTEM

BACKGROUND OF THE INVENTION

I. Field of the Invention

This invention relates to aerodynamic toys to be thrown through the air and, in particular, to a toy glider/airplane which utilizes a flexible wing structure to alter the flight characteristics of the device.

II. Description of the Prior Art

In the past, aerodynamic devices resembling airplane gliders have become quite popular as throwable gliding toy implements. In the usual embodiment, the toy is made of a paper, balsa wood or plastic material in the shape of an airplane having two or more distinct wings and a rigid main body. Throwing is accomplished by gripping the main body and tossing the device nose first through the air. The appeal of the toy resides in the fact that it exhibits definite aerodynamic characteristics and can be made to do a number of various maneuvers.

SUMMARY OF THE PRESENT INVENTION

The present invention is an improved glider type aerodynamic toy which overcomes all of the disadvantages of the previously known aerodynamic toys.

The aerodynamic toy according to the present invention comprises a generally elongated fuselage attached to a flat wing construction. The wing construction of the preferred form of the invention comprises a flat disk made of a flexible material such as styrofoam or plastic with an offset cut-out. Secured to the flexible wing is a wing adjuster which slideably accepts the fuselage and allows for adjustment of the wing construction relative to the fuselage. The preferred embodiment of the invention further comprises an adjustable nosepiece connected to the front end of the fuselage which acts as a balance weight. Secured to either the rear portion of the fuselage or to rear portion of the wing construction is a rudder which adds to the aerodynamic stability of the device.

In assembling the aerodynamic toy, the fuselage is passed through the wing adjuster attached to the top of the wing and through the cut-out in the wing construction, thereby causing a slight upturn of the rear portion of the wing. The front portion of the wing is held in close contact with the fuselage by the wing adjuster and, therefore, essentially parallel to the fuselage. However, it is the angle of the rear portion of the wing with respect to the fuselage which provides the aerodynamic properties of the device.

The flight characteristics of the device can be altered by varying the relative position of the wing construction with respect to the fuselage and by varying the configuration of the wing construction and the cut-out.

Other objects, features, and advantages of the invention will be apparent from the following detailed description taken in connection with the accompanying drawings.

BRIEF DESCRIPTION OF THE DRAWING

The present invention will be more fully understood by reference to the following detailed description of the preferred embodiment of the present invention when read in conjunction with the accompanying drawing, in which like reference characters refer to like parts throughout the views, and in which:

FIG. 6 is a top plan view of the alternative embodiment of the wing construction;

FIG. 7 is a front plan view of an alternative embodiment of the wing adjuster assembly;

FIG. 8 is a side plan view of the wing adjuster assembly of FIG. 7;

FIG. 9 is a bottom plan view of the wing adjuster assembly of FIG. 7;

FIG. 10 is a partial enlarged top view of an alternative embodiment of the aerodynamic toy utilizing the wing construction of FIG. 6 and the wing adjuster assembly of FIG. 7;

FIGS. 11*a*–11*f* are alternative embodiments of the toy glider system;

DETAILED DESCRIPTION OF THE PREFERRED EMBODIMENT

Figure 1:
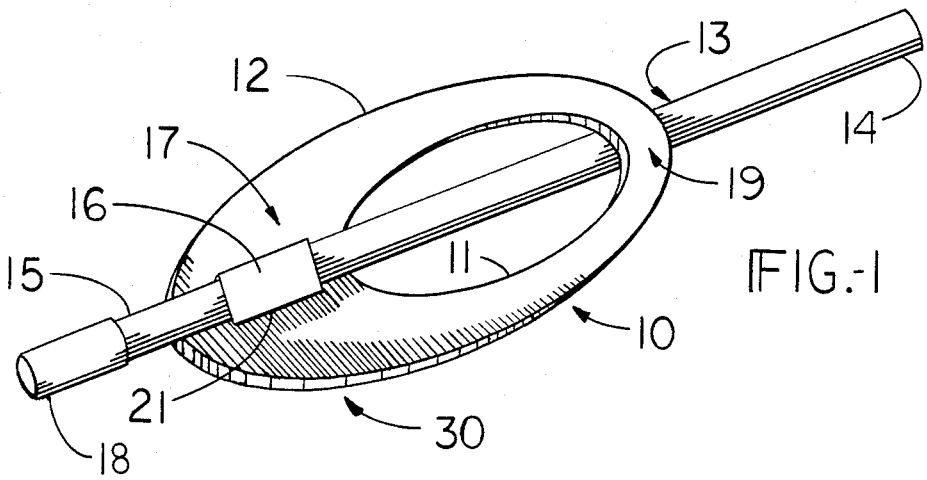
FIG. 1 is an elevated view of the preferred embodiment of the present invention.
Figure 3:
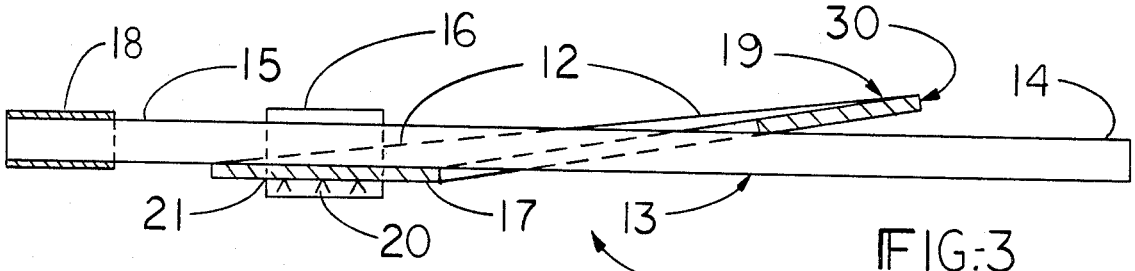
FIG. 3 is a cross-sectional view taken along lines 3—3 of FIG. 2.
Figure 2:
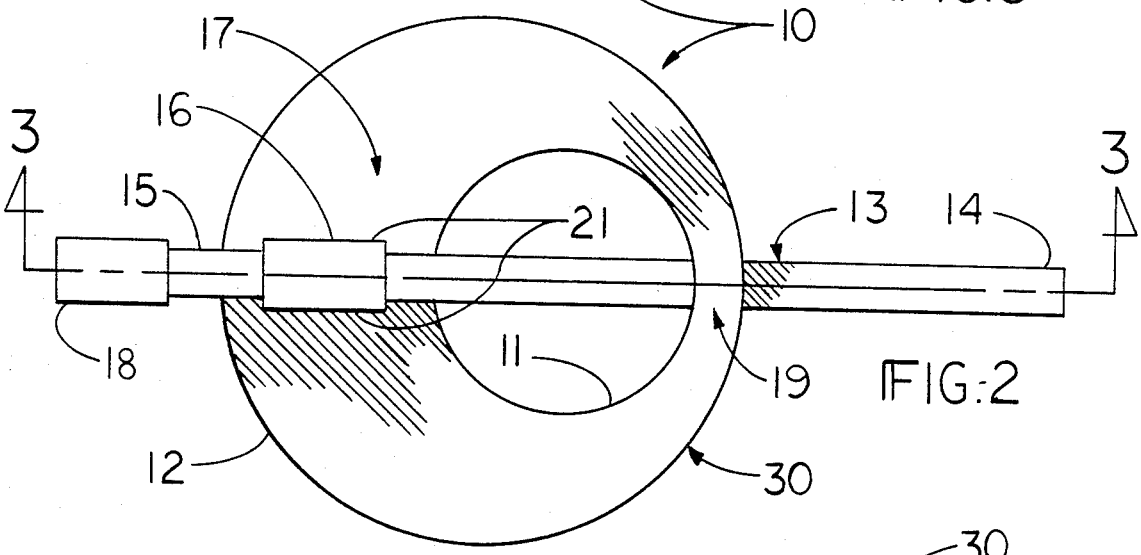
FIG. 2 is a top plan view of the aerodynamic toy of FIG. 1.
Figure 4:
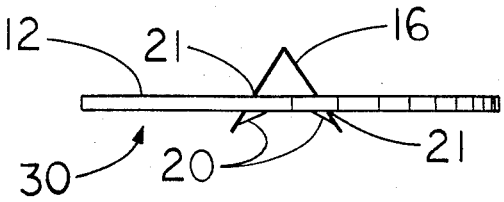
FIG. 4 is a front plan view of the wing construction.

Referring now to FIGS. 1 through 4, there is shown an aerodynamic device 10 embodying the present invention and comprising an elongated fuselage or body 13 and wing construction 30. The fuselage 13 is preferably tubular and made of a strong plastic and consists of rear portion 14 and front end 15. Attached to end 15 of the fuselage 13 is the nosepiece 18 which acts as a balance weight for the device and can be slidably adjusted relative to the fuselage 13 to vary the flight characteristics of the aerodynamic device 10.

Figure 5:
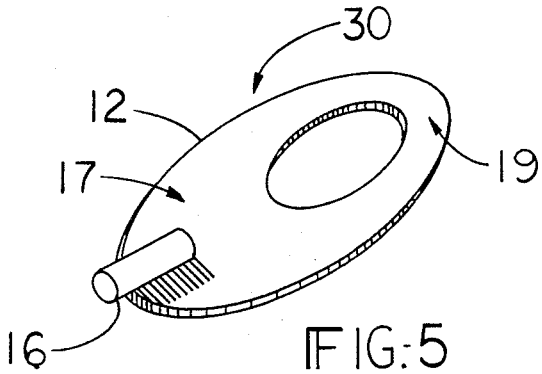
FIG. 5 is an elevated view of an alternative embodiment of the wing construction.

The wing construction 30 comprises a wing adjuster 16 which is secured by means 20 to the wing 12. The wing adjuster 16 preferably is a rectangular piece of plastic or cardboard folded in half to form a triangular housing and placed through slots 21 in the wing 12. The adjuster 16 is then secured to the wing 12 by tabs 20. Alternative embodiments of the wing adjuster 16 are shown in FIGS. 5 and 7 through 10. In FIG. 5, the alternative embodiment of the wing adjuster 16 comprises a cardboard or plastic tube securely attached to the wing 12.

FIGS. 7 through 9 show an embodiment of the wing adjuster 16 which is separable from the wing 12 and comprises a molded plastic member having a tubular portion 23 and two flat triangular portions 22. As is shown in FIG. 10, two of these wing adjusters 16 and 16' attach to the wing embodiment 12 shown in FIG. 7 along the longitudinal axis 25, and facilitate attachment of the wing construction to the fuselage 13.

Referring again to FIGS. 1 through 4, the wing construction 30 also comprises a wing 12 which is made of a flexible material such as styrofoam, plastic or cardboard. The preferred embodiment of the wing 12 is a thin flat disc with an annular cutout 11. The cutout 11 is offset from the center of the disc such that the front portion 17 of the wing 12 is wider than the rear portion 19. It is this cutout 11 which provides the remarkable aerodynamic qualities of the device. The wing adjuster 16 is secured to the wider front portion 17 of the wing 12. FIG. 7 and 11*a* through 11*f* disclose alternate configurations of the wing 12.

Figure 12:
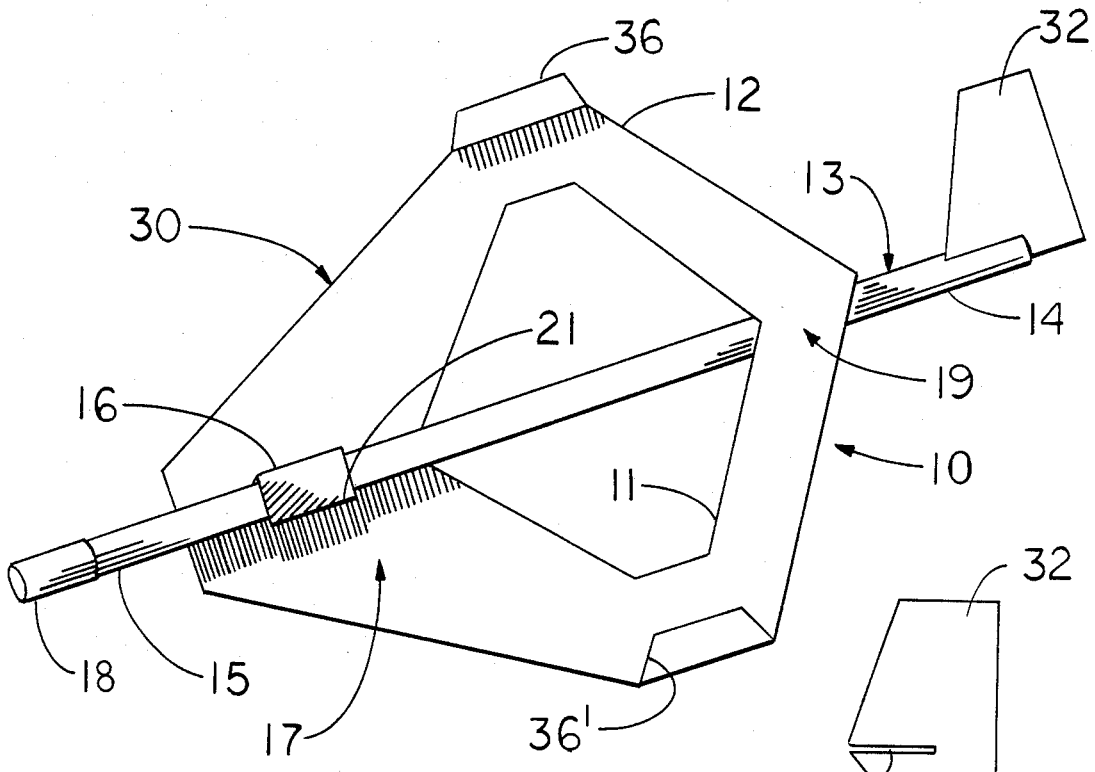
FIG. 12 is an elevated view of a further modification of the toy glider system.
Figure 12A:
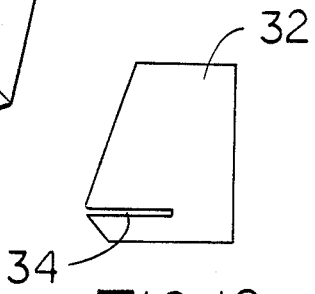
FIG. 12*a* is a side plan view of the rudder shown in FIG. 12.
Figure 14:
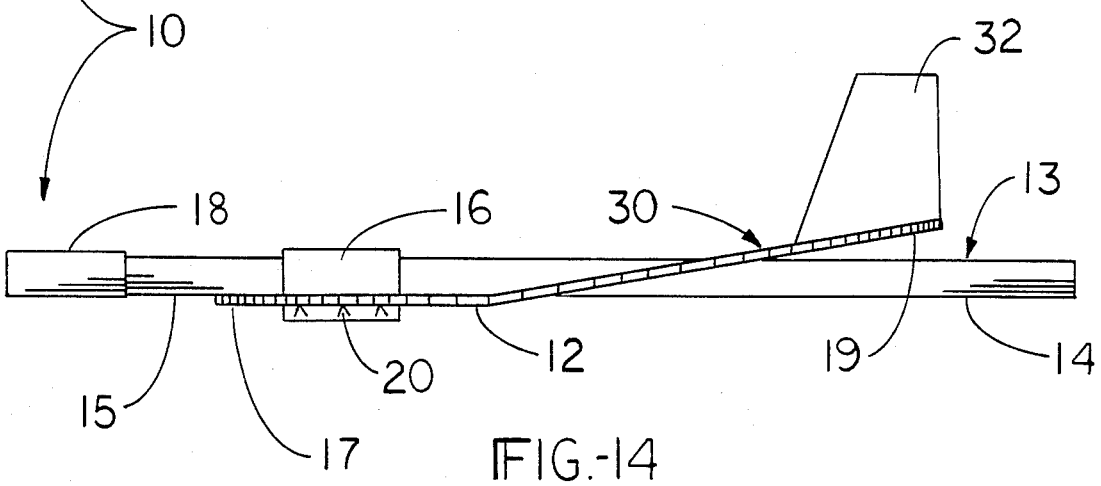
FIG. 14 is a side plan view of a still further modification of the toy glider system.

A still further modification of the preferred embodiment of the toy glider is shown in FIG. 12 which discloses a wing 12 with wing tips 36 and 36'. The wing tips 36 and 36' are part of the construction of the wing 12 but are bent upward and provide improved aerodynamic stability. Also included in the embodiment shown in FIG. 12 is a rudder 32 which is made of the same plastic or styrofoam material used in the wing 12. The rudder 32 is attached to end 14 of the fuselage 13 by way of a slot 34 cut out of the rudder 32 (see FIG. 12*a*). The slot 34 is designed to slidably accept the wall of the fuselage 13. FIG. 14 shows the original embodiment of the toy glider with rudder 32 secured to rear portion 19 of wing 12.

In assembling the aerodynamic device 10, end 14 of fuselage 13 is slid through the wing adjuster 16 and through the wing cutout 11 such that the front portion 17 of the wing 12 is essentially parallel to the fuselage 13 and the rest of wing 12 is held at an angle relative to the fuselage 13 with the rear portion 19 of wing 12 angled above and in contact with the fuselage 13.

Figure 13:
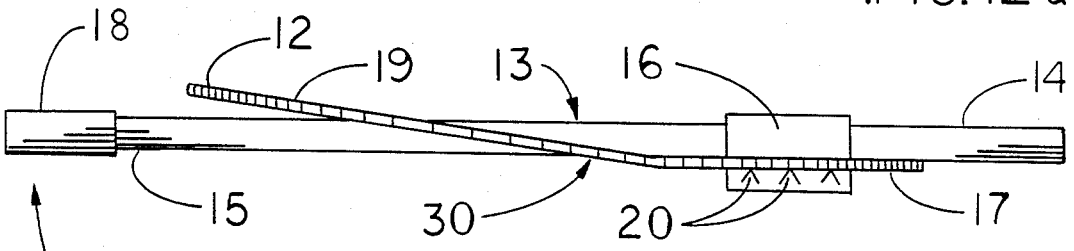
FIG. 13 is a side plan view of an alternative configuration of the toy glider system.

FIG. 13 shows a configuration of the aerodynamic toy with the wing construction 30 reversed relative to the fuselage 13. The construction of the glider remains the same but the position of the fuselage 13 relative to the wing construction 30 has been reversed whereby portion 19 of wing 12 is still angled above the fuselage 13 but has now become the front portion of the wing 12.

The aerodynamic properties of the device 10 are provided by the angle of the wing 12 in conjunction with the cutout 11. When the device 10 is thrown, the air rushing over the wing 12 and through the cutout 11 supplies the lift necessary for flight. The pattern or characteristics of the flight can be altered either by adjusting the position of the wing construction 30 relative to the fuselage 13; by adjusting nosepiece 18; or by changing the configuration of the wing 12.

Thus, the aerodynamic device provides not only improved flight characteristics but also the flexibility to allow alteration of flight properties to the specification of the user.

The foregoing detailed description has been given for clearness of understanding only and no unnecessary limitations should be understood therefrom as some modifications will be obvious to those skilled in the art.

What is claimed is:

1. An aerodynamic device comprising:

a planar member with an opening, a top surface and a bottom surface an elongated fuselage passing through said opening obliquely with respect to the plane of said opening so that a bottom surface of a portion of said fuselage is positioned above said planar member top surface and so that a top surface of a further portion of said fuselage is positioned below said planar member bottom surface; and means for accepting said fuselage attached to said planar member.

2. The aerodynamic device as defined in claim 1 further comprising a nosepiece attached to said fuselage which acts as a balance weight to improve the aerodynamic properties of the device.

3. The aerodynamic device as defined in claim 1 wherein the opening of said planar member is offset from the center of said planar member such that said first edge of said planar member is wider than said second edge.

4. The aerodynamic device as defined in claim wherein said accepting means is attached adjacent one edge of said opening of said planar member.

5. The aerodynamic device as defined in claim 1 further comprising a planar rudder slideably attached to said fuselage.

6. The aerodynamic device as defined in claim 1 wherein said accepting means allows adjustment of the position of said planar member relative to said fuselage for different flight characteristics.

7. The aerodynamic device as defined in claim 1 wherein said angled planar member provides the aerodynamic properties of the device.

* * * * *